US006347585B1

(12) United States Patent
Kiamco et al.

(10) Patent No.: US 6,347,585 B1
(45) **Date of Patent: *Feb. 19, 2002**

(54) VARIABLE GAP STABILIZER

(75) Inventors: Robert C. Kiamco, Wood Dale; Lawrence J. Bain, LaGrange; John M. Lee, Barrington; Mark Milazzo, Evanston, all of IL (US)

(73) Assignee: Goss Graphic Systems, Inc., Westmont, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/128,701

(22) Filed: Aug. 4, 1998

(51) Int. Cl.[7] ..... B41F 31/00; B41F 13/24

(52) U.S. Cl. ..... 101/351.1; 101/352.01; 101/352.05; 101/351.4; 101/247

(58) Field of Search ..... 101/148, 331, 101/347, 367, 247, 351.1, 351.3, 351.4, 352.01, 352.04, 352.05

(56) References Cited

U.S. PATENT DOCUMENTS

| | | | | | |
|---|---|---|---|---|---|
| 3,343,484 | A | * | 9/1967 | Dahlgren | 101/148 |
| 3,448,686 | A | | 6/1969 | Bohman | |
| 3,691,956 | A | * | 9/1972 | James et al. | 101/247 |
| 3,732,814 | A | | 5/1973 | Pasquinelli | |
| 3,769,909 | A | * | 11/1973 | Fugman et al. | 101/148 |
| 3,996,856 | A | | 12/1976 | Beisel | |
| 4,214,527 | A | * | 7/1980 | Kamota | 101/247 |
| 4,290,359 | A | * | 9/1981 | Kapoor | 101/148 |
| 4,351,236 | A | * | 9/1982 | Beisel et al. | 101/148 |
| 4,503,771 | A | * | 3/1985 | Herzel et al. | 101/247 |
| 4,907,507 | A | * | 3/1990 | Ishii et al. | 101/142 |
| 4,944,223 | A | * | 7/1990 | Ishii et al. | 101/148 |
| 4,972,771 | A | * | 11/1990 | Weisgerber et al. | 101/148 |
| 4,986,176 | A | * | 1/1991 | Ishii et al. | 101/148 |
| 5,081,925 | A | * | 1/1992 | Holl et al. | 101/148 |
| 5,119,727 | A | * | 6/1992 | Miyamoto et al. | 101/352 |
| 5,179,898 | A | | 1/1993 | Sun | |
| 5,186,100 | A | * | 2/1993 | Turtorro et al. | 101/40 |

FOREIGN PATENT DOCUMENTS

| | | |
|---|---|---|
| CA | 1128811 | 8/1982 |
| DE | 2143998 | 1/1973 |
| DE | 3316940 | 9/1983 |
| DE | 44 01 300 A1 | 8/1994 |
| GB | 2184982 | 7/1987 |

OTHER PUBLICATIONS

PcT International Search Report, Appl. No. PCT/US99/17689 mailed Jan. 11, 2000.

* cited by examiner

*Primary Examiner*—Kimberly L. Asher
(74) *Attorney, Agent, or Firm*—Marshall, Gerstein, & Borun

(57) ABSTRACT

A gap adjusting device for a rotary press comprises a frame and a fountain roller and a metering roller which are both rotatably mounted relative to the frame. A gap is defined between the metering roller and the fountain roller, and an adjustment member is provided which has an actuator for alternatively moving the rollers toward and away from each other, thereby decreasing or increasing, respectively, the size of the gap. Additionally, the gap adjusting device includes a stabilizing member for stabilizing the metering roller.

24 Claims, 3 Drawing Sheets

VARIABLE GAP STABILIZER

FIELD OF THE INVENTION

The present invention relates generally to rotary offset printing presses. More specifically, the present invention relates to a variable gap adjusting device for adjusting the gap between a metering roller and a fountain roller, and for stabilizing the metering roller during press operations.

BACKGROUND OF THE INVENTION

Rotary offset printing presses typically employ a metering roller mounted closely adjacent to a fountain roller such that the rollers define a small gap between each other. A raised bearer ring on the fountain bears against the body of the metering roller in order to maintain a gap between the rollers. During operation of the press, it is desirable that the gap or distance between the rollers be precisely controlled. Ideally, a gap size of 3–5 thousandths of an inch is desirable.

However, during operation of the printing press it is quite common to experience a certain amount of ink buildup between the raised bearer ring and the metering roller. This ink build up gradually changes the gap distance, which adversely affects the printing process. The present bearer ring configuration employed to determine the gap size do not provide a mechanism for maintaining a constant gap size nor do the provide a mechanism for adjusting the size of the gap. Thus the press must be stopped periodically in order to clean the rollers so that the proper gap distance can be restored, or to adjust the gap to the desired size.

Another drawback with the present bearer ring configurations is that as the rollers wear, the gap size gradually changes, which also adversely affects performance of the printing press. Because the present configurations do not allow for the adjustment of the gap, the rollers must be periodically replaced as they wear, resulting in increased down time and increased material and labor costs. Also, during normal operations the press experiences a certain amount of vibration, which may inadvertently alter the gap between the rollers. This constant gap variation also has a detrimental effect on the performance of the printing press. None of the bearer ring configurations presently employed provide a mechanism for maintaining a constant gap size.

Accordingly, there exists a need for a device for rotary offset printing presses that will enable the gap size between the metering and fountain rollers to be controlled, that will permit the adjustment of the gap, and which will stabilize the metering roller relative to the fountain roller.

SUMMARY OF THE INVENTION

The present invention allows for the precise control and variable adjustment of the gap between the metering roller and the fountain roller, which maintains the desired gap size and which permits the roller position to be adjusted to accommodate ink build up during normal press operations. The present device also allows the gap to be adjusted to account for normal wear and tear. Fast and precise adjustment of the gap is possible and the rollers are stabilized to prevent vibration and movement, thus enhancing performance of the printer.

According to one aspect of the present invention, a gap adjusting device for a rotary press comprises a frame, a fountain roller rotatably mounted to the frame, and a stabilizing member mounted adjacent to the fountain roller. A metering roller is rotatably mounted to an eccentric member, and a gap is defined between the metering roller and the fountain roller. The eccentric member is pivotally mounted to the frame by a bearing ring having an outer race, and a portion of the outer race is positioned to contact the stabilizing member. An actuator is connected to the eccentric member for rotating the eccentric member within the bearing ring, so that upon rotation of the eccentric member the size of the gap is varied.

In further accordance with one embodiment of the invention, the eccentric member includes a mechanical stop which is positioned to abut a portion of the frame, and the mechanical stop is provided with a locking adjustment screw or bolt in order to further secure the position of the eccentric member. The actuator for shifting the eccentric member is preferably an air cylinder, although a hydraulic cylinder or other mechanical actuator may also be employed. The bearing ring is provided with a clamp for fixing the position of the bearing ring relative to the eccentric member.

The stabilizing member is preferably a hardened cam, which is mounted on a bearing concentric with the central axis of the fountain roller and which is rotatable about the central axis. The cam member abuts the outer race of the bearing ring that supports the eccentric member, and serves to stabilize the position of the metering roller relative to the fountain roller. The bearing ring that supports the stabilizing member preferably includes a flange having an elongated slot, thus permitting the position of the cam member to be changed by rotating the stabilizing member within its bearing ring. A lock nut or similar device secures the position of the cam member.

The eccentric member is pivotally mounted within a bearing ring having an outer race, so that the eccentric member pivots about a pivot point. The metering roller is rotatably mounted to the eccentric member, but the central axis of the metering roller is offset from the eccentric member pivot point, so that upon rotational movement of the eccentric member, the metering roller is moved toward or away from the fountain roller, thereby decreasing or increasing, respectively, the size of the gap between the rollers.

According to another aspect of the invention, a gap adjusting device for a rotary press includes a fountain roller rotatably mounted to a frame, and a stabilizing member mounted adjacent to the fountain roller. A metering roller is rotatably supported by an adjustment member, and a gap is formed between the metering roller and the fountain roller. The adjustment member is supported for shiftable movement relative to the frame, and an abutment member mounted to the adjustment member is positioned to contact the stabilizing member. An actuator connected to the adjustment member shifts the adjustment member, thereby moving the metering roller and the fountain roller relative to each other so that the size of the gap can be varied.

In accordance with a further embodiment of the invention, a gap adjusting device for a rotary press includes a frame, a fountain roller and a metering roller is rotatably mounted to the frame so that a gap is formed between the rollers. Adjustment means having an actuator is provided for shifting one of the rollers toward or away from the other roller, thereby decreasing or increasing, respectively, the size of the gap therebetween. Stabilizing means is provided for stabilizing the metering roller.

The aforementioned features and advantages, in addition to other features and advantages, will become readily apparent to those skilled in the art upon a reading of the following detailed description.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
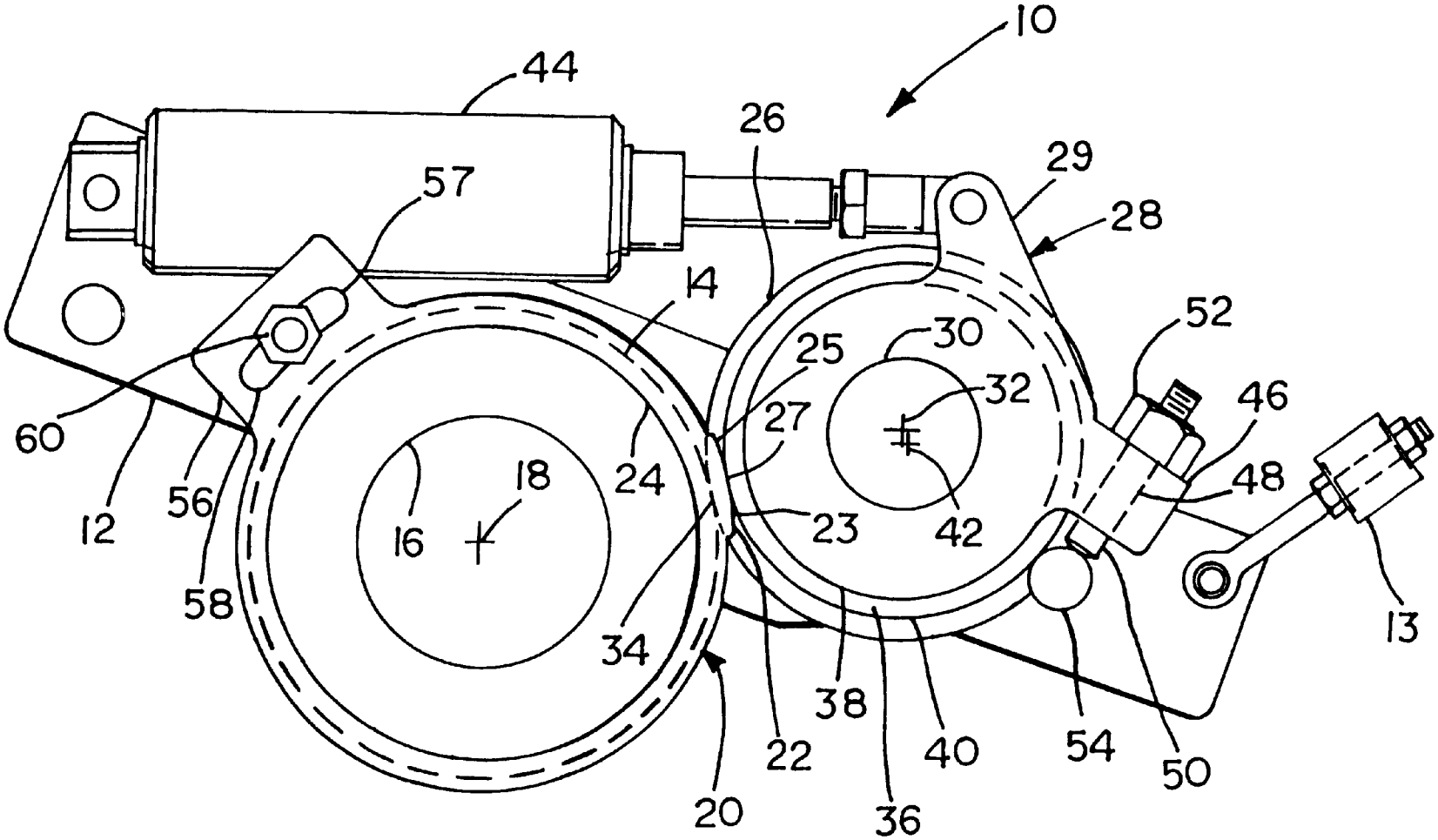
FIG. 1 is a fragmentary elevational schematic view of the adjustable gap stabilizer for a rotary press assembled according to the teachings of the present invention.

Referring now to the drawings, FIG. 1 shows a gap adjusting device assembled according to the teachings of the present invention which is generally referred to by the reference numeral 10 and which is adapted for use on a rotary offset printing press (not shown). Device 10 includes a frame 12 and a fountain roller 14 which is mounted on frame 12 by a bearing 16 for rotation about a central axis 18. Preferably, an actuator 13 is provided so that frame 12 is adjustable with respect to other components of the rotary press (not shown). A stabilizing member 20 having a cam 22 is rotatably mounted on a bearing 24. Preferably, cam 22 includes a pair of variably sloping side portions 23, 25, respectively, as well as a raised center area 27, such that the effective radius of cam 22 is less than the radius of stabilizing member 20. A metering roller 26 is rotatably and eccentrically mounted to an eccentric member 28 by a bearing 30 for rotation about a central axis 32. A gap 34 is defined between the fountain roller 14 and the metering roller 26. The eccentric member 28 is pivotally mounted in a bearing ring 36 having an inner race 38 and an outer race or surface 40, so that the eccentric member can pivot about a central axis 42. As can be seen in the drawings, the central axis 32 of the metering roller 26 is offset from the central axis 42 of the eccentric member 28.

Eccentric member 28 includes a lug 29, and an actuator 44 connected to lug 29 adjustably connects the eccentric member 28 to the frame 12, so that eccentric member 28 can be rotated about its central axis 42 thus enabling the gap 34 between the fountain roller 14 and the metering roller 26 to be varied by virtue of the eccentric mounting of metering roller 26 to eccentric member 28. Accordingly, the eccentric member 28, using the actuator 44, may effectively be used to make small adjustments to the size of the gap 34, or alternatively may function as a throw-off device in order to greatly increase the size of the gap 34 for maintenance and other purposes. For example, when the actuator 44 is configured as shown, extension of the actuator 44 will cause the metering roller 26 to move away from the fountain roller 14 and increase the gap 34 as the eccentric member rotates about its central axis 42. By comparison, retraction of the actuator 44 will cause the metering roller 26 to move toward the fountain roller 14 and decrease the gap 34. Preferably, actuator 44 is a pneumatic cylinder, although a hydraulic cylinder, a threaded rod, or any suitable mechanical linkage system may be used as an alternative.

Eccentric member 28 includes a second lug 46 having a bore 48 extending therethrough which threadably receives an adjusting bolt 50 having a lock nut 52. The end of the bolt 50 is positioned to abut a lug 54 extending from the frame 12. Bolt 50 serves to carry some of the load experienced by actuator 44 during operation of the press, and further stabilizes the relative positions of fountain roller 14 and metering roller 26. Upon retraction of the actuator 44 as discussed above, the eccentric member 28 rotates in a counterclockwise direction when viewing the drawings, which pulls the end of bolt 50 away from the lug 54. On the other hand, when it is desired to increase the gap 34 by extending actuator 44, bolt 50 must first be retracted.

Stabilizing member 20 includes a lug or flange 56 having an arcuate slot 57, and further includes a bolt 60 or similar fastener. Stabilizing member 20 can be rotated about bearing 24 in order to adjust the position of cam 22, and bolt 60 enables the rotational position of cam 22 to be fixed. Preferably, the stabilizing member is concentric with the fountain roller 14 so that the stabilizing member also rotates about the central axis 18.

Figure 3:
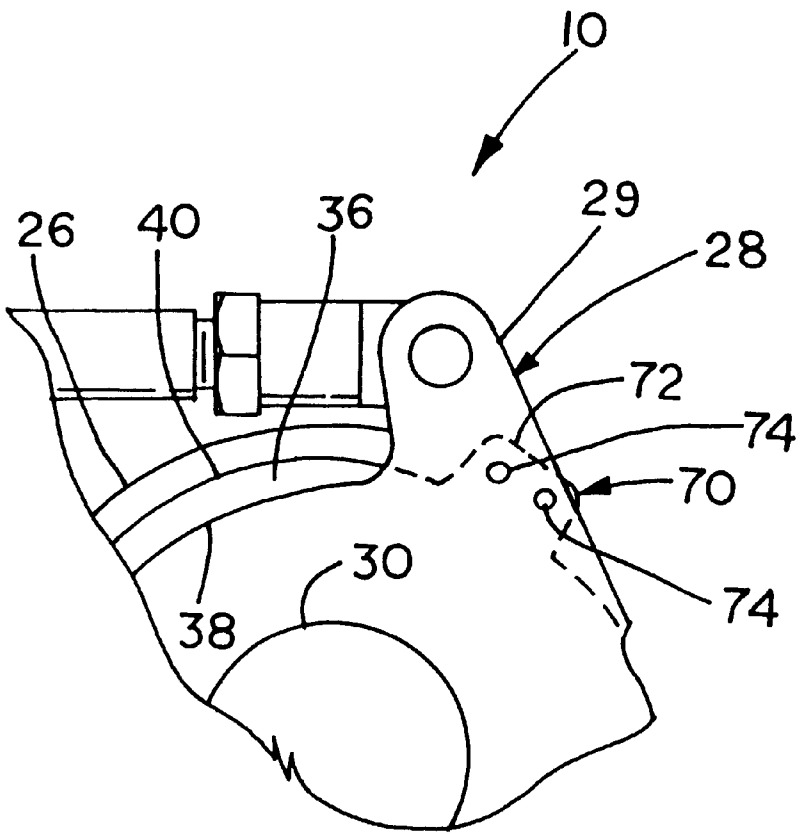
FIG. 3 is a fragmentary elevational view, similar to FIG. 1, illustrating an adjustable anti-rotation clamp for fixing the position of the metering roller outer race when the metering roller has been temporarily thrown off.

Referring now to FIG. 3, the bearing ring 36 preferably includes a clamp 70 for fixing the position of the bearing ring 36 relative to the eccentric member 28. The clamp 70 includes a tab 72 on the bearing ring 36. The tab 72 is secured to the eccentric member 28 by a plurality of bolts 74. The function of the clamp 70 is as follows. Ink tends to accumulate on the outer surface 40 of the bearing ring 36 (i.e., above and below the point of contact between the cam 22 and the outer surface 40 of the bearing ring 36) during operation of the press. However, due to the contact between the cam 22 and the outer surface 40 of the bearing ring 36, no ink accumulates at this point of contact. After the eccentric member has been thrown-off as discussed above, it is therefore desirable to bring the cam 22 and the outer surface 40 back into contact at this same, uncontaminated contact point. The clamp 70, by preventing rotation of the bearing ring 36 during throw-off, ensures that the same contact point is maintained, which thus maintains the proper size of the gap 34 when the eccentric member 28 is thrown back to its operative position.

Figure 2:
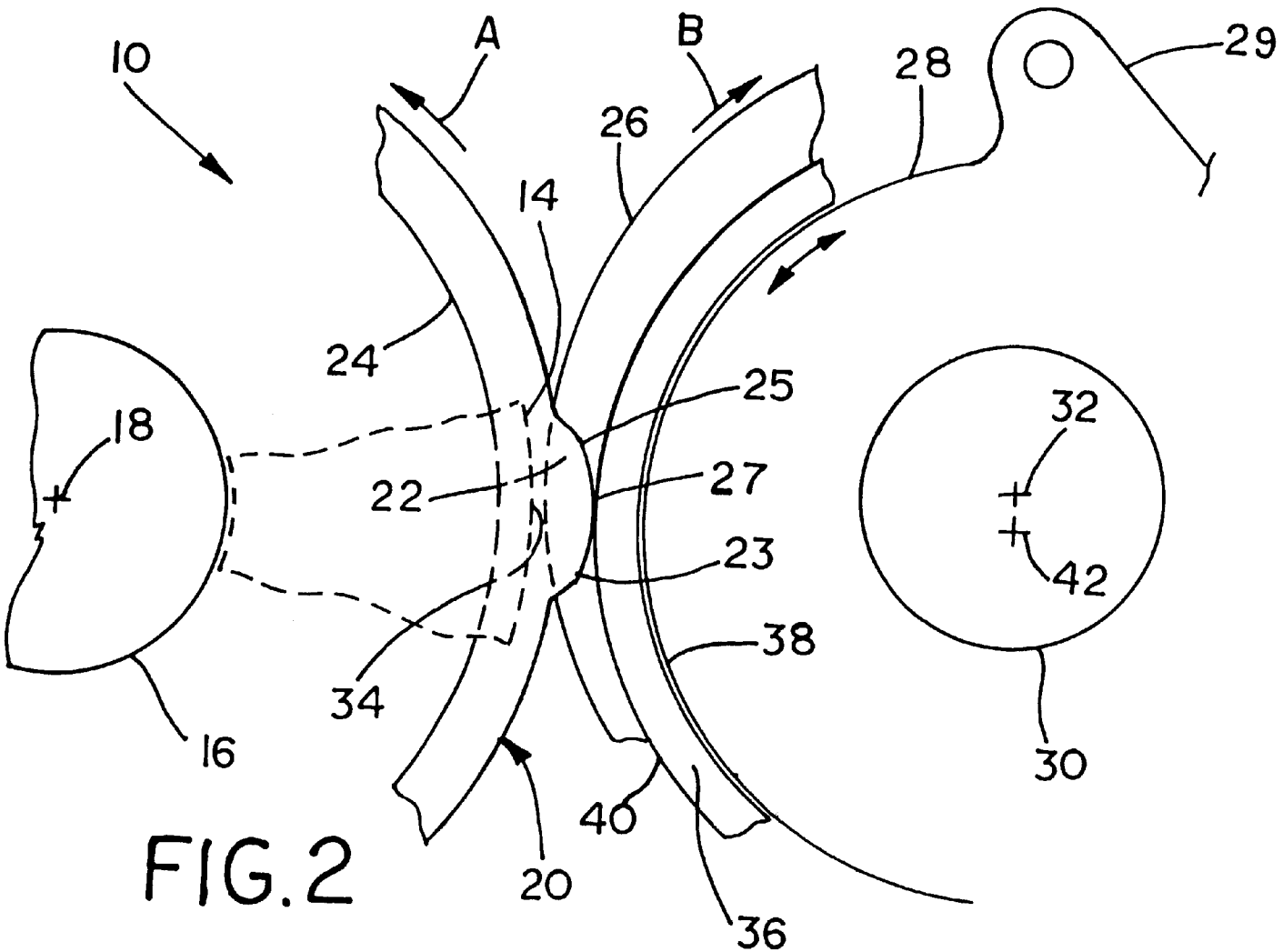
FIG. 2 is an enlarged fragmentary cross-sectional view thereof.

In operation, fountain roller 14 and metering roller 26 are driven by a drive system (not shown) as is commonly employed in the art, so that the fountain roller 14 rotates in a counter-clockwise direction when viewing the drawings, as indicated by the reference arrow "A", while the metering roller 26 rotates in a clockwise direction when viewing the drawings, as indicated by the reference arrow "B", see FIG. 2. Alternatively, the rollers may rotate in the direction opposite of that shown. Stabilizing member 20 is positioned by rotating it about the axis 18 so that the cam 22 abuts the outer race 40 of bearing ring 36. The available amount of rotation of stabilizing member 20 is governed by the length of arcuate slot 58, and the position is secured by tightening bolt 60. With the stabilizing member thus secured, and with cam 22 in contact with the outer race 40 of bearing ring 36, the relative position of fountain roller 14 and metering roller 26 is stabilized, subject only to the adjustment as discussed further below.

In order to achieve minute adjustments to gap 34, stabilizing member can be rotated upon release of the bolt 60, thereby changing the gap 34 by positioning the raised portion 27 or either of the sloping side portions 23, 25 in contact with bearing ring 36. The sloping side portions 23, 25 may be configured so that the range of adjustability is maximized or minimized, depending on user preferences, and may also be symmetrical or non-symmetrical with respect to the raised portion 27.

Alternatively, the size of the gap 34 between the fountain roller 14 and the metering roller 26 may be set at the desired distance by extending or retracting the actuator 44. As outlined above, by virtue of the eccentric mounting of the metering roller 26 to the eccentric member 28 (e.g. the offset between the central axis 32 of the metering roller 26 and the central axis 42 of the eccentric member 28) the size of the gap 34 is varied upon rotation of the eccentric member 28. Typically, the bolt 50 is retracted away from the lug 54 in order to accomplish the adjustment. When the desired size is achieved for the gap 34, the bolt 50 is advanced until its end abuts the lug 54, and the bolt 50 is secured in place using the lock nut 52.

Subsequently, during operation of the press (not shown), ink may build up on one or both of the rollers, thus decreasing the effective size of gap 34. In order to accommodate for this ink build up, and in order to avoid the concomitant adverse effects on print quality, the gap 34 can be increased or decreased by adjusting the stabilizing member 20 and/or the eccentric member 28.

It will be understood that the above description does not limit the invention to the above-given details. It is contemplated that various modifications and substitutions can be made without departing from the spirit and scope of the following claims.

What is claimed is:

1. A gap adjusting device for a rotary press, comprising:

a frame;

a fountain roller having an axis and being rotatably mounted to the frame;

a stabilizing member mounted to the frame and operatively engaging the fountain roller and being rotatable about an axis coaxial with the axis of the fountain roller;

a metering roller having an axis and being rotatably mounted to an eccentric member, the metering roller and the fountain roller defining a gap therebetween, the eccentric member being pivotally mounted to the frame within a first bearing ring having an outer surface, the eccentric member being moveable about a pivot axis offset from the metering roller axis so that the size of the gap is adjustable in response to movement of the eccentric member about the pivot axis, a portion of the outer surface of the first bearing ring being in contact with the stabilizing member thereby permitting a distance between the fountain roller axis and the outer surface of the first bearing ring to be stabilized; and an actuator connected to the eccentric member for rotating the eccentric member within the first bearing ring, thereby permitting adjustment of the gap between the fountain roller and the metering roller.

2. The device of claim 1, wherein the eccentric member includes a mechanical stop, the mechanical stop adjustably abutting a portion of the frame.

3. The device of claim 2, wherein the mechanical stop includes an adjustable screw having a lock nut for fixing the rotational position of the eccentric member.

4. The device of claim 1, wherein the actuator is an air cylinder.

5. The device of claim 1, wherein the actuator is an air cylinder, and the eccentric member includes a mechanical stop having an adjustment screw with a lock nut, the adjustment screw abutting a portion of the frame and being adapted to fix the position of the eccentric member.

6. The device of claim 1, wherein the stabilizing member is rotatably mounted in a second bearing ring and includes a hardened cam, the hardened cam including a raised portion and at least one sloping portion, the stabilizing member and the outer surface of the first bearing ring meeting at a point of contact on the hardened cam, whereby the point of contact between the second bearing ring and the outer surface of the first bearing ring is adjustable between the raised portion and the sloping portion by rotating the second bearing ring, thereby permitting additional adjustment of the gap.

7. The device of claim 6, wherein the second bearing ring includes an arcuate slot and a lock nut positioned in the slot for adjustable fixing the rotational position of the stabilizing member.

8. The device of claim 1, wherein the actuator is shiftable between an extended position in which the gap is increased and a retracted position in which the gap is decreased.

9. A gap adjusting device for a rotary press, comprising:

a fountain roller rotatably mounted to a frame;

a stabilizing member mounted to a first bearing ring disposed generally concentrically with the fountain roller and including a cam portion, the stabilizing member operatively engaging the fountain roller but being rotatable relative to the fountain roller;

a metering roller rotatably and eccentrically supported by an adjustment member, the metering roller and the fountain roller defining a gap therebetween, the adjustment member being supported within a second bearing ring for shiftable movement relative to the frame such that the gap size is adjustable in response to movement of the adjustment member, the second bearing ring including an outer surface, a portion of the outer surface of the second bearing ring being disposed in contact with the cam portion of the stabilizing member, the contact between the outer surface of the second bearing ring and the cam portion of the stabilizing member thereby serving to stabilize the relative positions of the fountain roller and the metering roller; and an actuator connected to the adjustment member for shifting the adjustment member, thereby adjusting the gap between the metering roller and the fountain roller.

10. The device of claim 9, wherein the stabilizing member may be fixed in a plurality of positions, thereby permitting adjustment of the gap independent of movement of the adjustment member.

11. The device of claim 9, wherein the adjustment member includes a mechanical stop for limiting shiftable movement of the adjustment member, the mechanical stop positioned to abut a portion of the frame.

12. The device of claim 11, wherein the mechanical stop includes an adjustable screw having a lock nut for fixing the position of the adjustment member.

13. The device of claim 9, wherein the actuator is an air cylinder.

14. The device of claim 9, wherein the actuator is shiftable between a first position in which the metering roller is moved away from the fountain roller and a second position in which the metering roller is moved toward the fountain roller.

15. A gap adjusting device for a rotary press, comprising:

a frame;

a fountain roller having an axis and being mounted to the frame;

a metering roller having an axis and being mounted to an adjustment member, the adjustment member being mounted to the frame within a bearing ring and being pivotable about a pivot axis offset from the metering roller axis so that upon movement of the adjustment member, the fountain roller and the metering roller may be selectively moved toward or away from each other, thereby decreasing or increasing, respectively, the size of a gap defined therebetween; and a stabilizing member shiftably mounted to the frame generally concentric with and operatively engaging the fountain roller, the stabilizing member including a cam member positioned in contact with an outer surface of the adjustment member bearing ring, the contact between the cam member and the bearing ring outer surface thereby stabilizing the position of the fountain roller relative to the metering roller.

16. The device of claim 15, wherein the stabilizing member includes a cam, the cam being mounted to a bearing ring mounted concentrically with the fountain roller.

17. The device of claim 15, wherein the adjustment member includes a mechanical stop, the mechanical stop positioned to abut a portion of the frame.

18. The device of claim 17, wherein the mechanical stop includes an adjustable screw having a lock nut for fixing the rotational position of the adjustment member.

19. The device of claim 15, and further including an actuator engaging the adjustment member for moving the adjustment member.

20. The device of claim 15, wherein the actuator is an air cylinder, and the adjustment member includes a mechanical stop having an adjustment screw with a lock nut, the adjustment screw abutting a portion of the frame to fix the position of the adjustment member.

21. The device of claim 15, wherein the stabilizing member includes a bearing ring mounted concentrically with the fountain roller and having a cam member, the cam member being rotatable about the axis of the bearing ring of the stabilizing member.

22. The device of claim 21, wherein the bearing ring of the stabilizing member includes an arcuate slot and a lock nut positioned in the slot for fixing the position of the cam member, the arcuate slot upon release of the lock nut permitting the cam member to rotate out of contact with the bearing ring of the metering roller.

23. The device of claim 15, wherein the metering roller rotates about a central axis and the adjustment member rotates about a pivot point, the metering roller central axis being offset from the adjustment member pivot point.

24. The device of claim 15, including an actuator connected to the adjustment member for rotating the adjustment member within the bearing ring, and wherein the actuator is shiftable between an extended position in which the gap is increased and a retracted position in which the gap is decreased.

* * * * *

UNITED STATES PATENT AND TRADEMARK OFFICE

CERTIFICATE OF CORRECTION

PATENT NO. : 6,347,585 B1
DATED : February 19, 2002
INVENTOR(S) : Kiamco et al.

It is certified that error appears in the above-identified patent and that said Letters Patent is hereby corrected as shown below:

Column 4,
Lines 42-43, delete “, see FIG. 2”.

Column 6,
Line 7, delete “adjustable” and insert -- adjustably --.

Signed and Sealed this

Thirty-first Day of December, 2002

JAMES E. ROGAN
*Director of the United States Patent and Trademark Office*